United States Patent [19]

Dills

[11] 4,020,323

[45] Apr. 26, 1977

[54] ENERGY SAVING BROILING OVEN

[75] Inventor: Raymond L. Dills, Louisville, Ky.

[73] Assignee: General Electric Company, Louisville, Ky.

[22] Filed: Apr. 28, 1975

[21] Appl. No.: 571,982

[52] U.S. Cl. ..... 219/405; 99/401; 99/447; 126/41 R; 219/348; 219/393; 219/398

[51] Int. Cl.[2] ..... H05B 1/02; A47J 37/00

[58] Field of Search ..... 126/41 R, 14; 99/385, 99/388, 393, 399, 396, 400, 401, 390, 446, 447; 219/385, 391–398, 402–405, 408–411, 348, 349, 354

[56] References Cited

UNITED STATES PATENTS

| | | | |
|---|---|---|---|
| 1,862,733 | 6/1932 | Wright | 99/392 X |
| 2,025,898 | 12/1935 | Rhodes | 99/401 UX |
| 2,456,988 | 12/1948 | Pierson | 99/446 |
| 2,836,697 | 5/1958 | Jordan | 126/41 R |
| 2,844,702 | 7/1958 | Staats | 126/41 R |
| 2,848,592 | 8/1958 | Mergen | 99/390 UX |
| 2,862,441 | 12/1958 | Schmall | 99/401 X |

*Primary Examiner*—A. Bartis
*Attorney, Agent, or Firm*—Richard L. Caslin; Francis H. Boos

[57] ABSTRACT

A broiling oven formed by an oven liner and an access door. Two electric radiant heating elements are located beneath the top wall of the oven liner. A hinged reflective plate is supported at each side of the innermost heating element. When these plates are lowered they form a miniature broiling compartment using the innermost heating element. When they are raised both heating elements may be operated together or separately.

10 Claims, 6 Drawing Figures

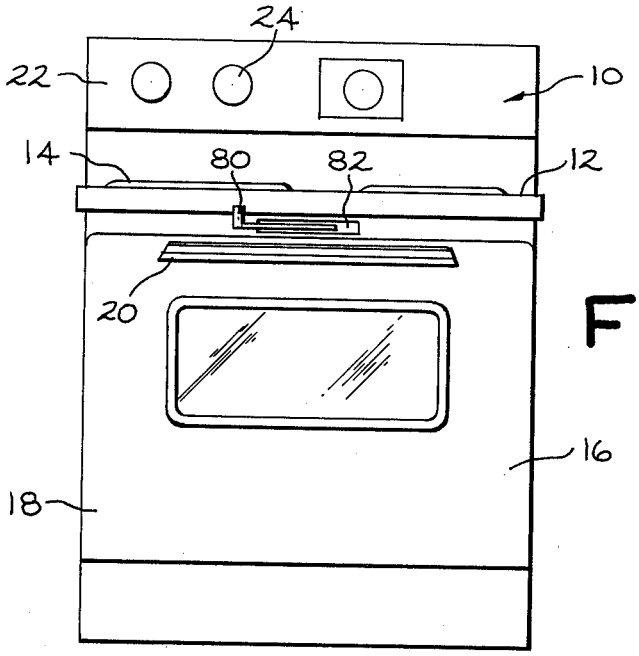
FIG. 1
FIG. 5
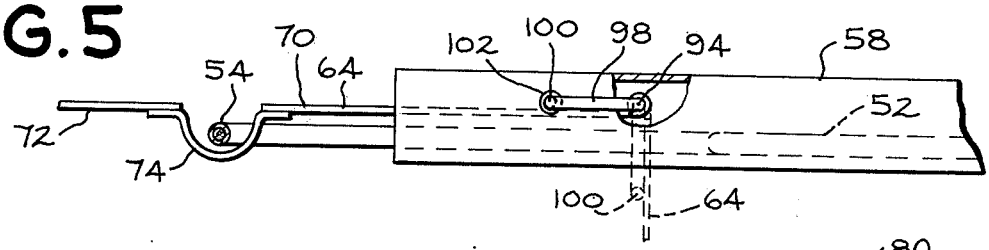
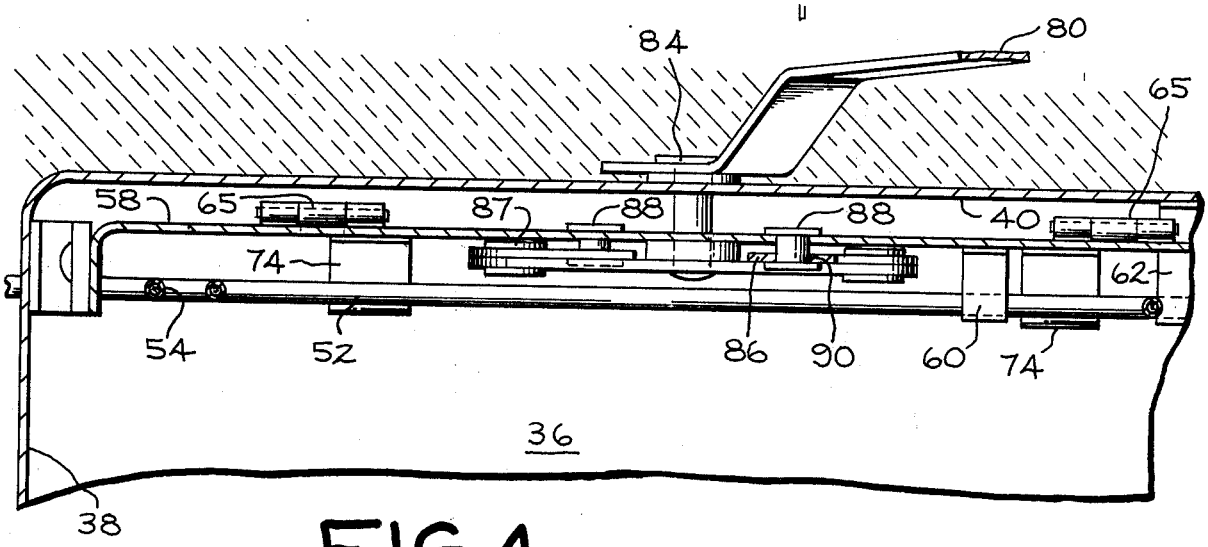
FIG. 4

ENERGY SAVING BROILING OVEN

BACKGROUND OF THE INVENTION

1. Field of the Invention

The invention relates to a boiling oven for use in cooking food in the oven from an overhead radiant heating source. Adjustable reflective plates are furnished in the oven to enable the formation of a miniature boiling compartment for boiling small food portions at a more rapid rate with much less energy.

2. Description of the Prior Art

For many years it has been possible to both bake and boil in a single electric oven cooking cavity. Baking is performed mainly by convection air currents set up by a bake heating element located adjacent the bottom wall of the oven liner. Broiling is performed mainly by radiant heat energy from an overhead broil element located adjacent the top wall of the oven liner. This broiling operation cooks only the top half of the food, hence the food must be turned over near the middle of the broiling operation to cook the bottom half. This broil element is usually energized at quarter wattage during the baking operation to provide top browning. See U.S. Pat. No. 2,836,697 of S. C. Jordan, which is assigned to the assignee of the present invention.

This Jordan patent provides for greater heating intensities during broiling operations by transposing the lower brake element and mounting it just beneath the top broiling element so as to supplement the radiant heat output of the primary broiling element.

Another broiling oven having means for varying the concentration or intensity of the heat radiated from the broil element is described in U.S. Pat. No. 2,844,702 of J. E. Staats, which is also assigned to the present assignee.

This Staats patent provides the broil element with a plurality of elongated reflectors, each pivotally mounted over a straight parallel portion of a sinuous, looped broil element. The elongated reflectors are all joined together by a link mechanism having a manual control knob "for positioning the reflectors so as to concentrate or focus the radiated heat in a desired pattern at any one of several oven rack positions."

A principal object of the present invention is to provide a large broiling oven cavity with the option of a miniature broiling compartment.

A further object of the present invention is to provide a broiling oven with adjustable reflective plates for forming a miniature broiling compartment so as to increase the rate of broiling while using less radiant heat energy.

A further object of the present invention is to provide a miniature broiling compartment of the class described where the reflected radiant energy is substantially confined within the compartment.

A further object of the present invention is to provide a broiling over with heat reflective plates which may be arranged to form a miniature broiling compartment in the top portion of the oven to substantially surround the food to be broiled therein.

SUMMARY OF THE INVENTION

The present invention, in accordance with one form thereof, relates to a broiling oven having a radiant heating source adjacent the top portion thereof. Adjustable reflective means cooperate with a portion of the radiant heating source for forming a miniature broiling compartment for broiling at a faster rate with less power than if the broiling operation were performed in the larger broiling oven.

BRIEF DESCRIPTION OF THE DRAWINGS

This invention will be better understood from the following description taken in conjunction with the accompanying drawings and its scope will be pointed out in the appended claims.

FIG. 1 is a front elevational view of an electric range having a baking and broiling oven embodying the present invention.

FIG. 4 is a fragmentary, cross-sectional elevational view taken generally on the line 4—4 of FIG. 3 to present a clearer understanding of the link mechanism for moving the adjustable reflector plates.

FIG. 5 is a fragmentary, front elevational view similar to FIG. 2 showing a second modification of means for supporting the adjustable reflector plates in a raised, generally horizontal position.

DESCRIPTION OF THE PREFERRED EMBODIMENTS

Figure 2:
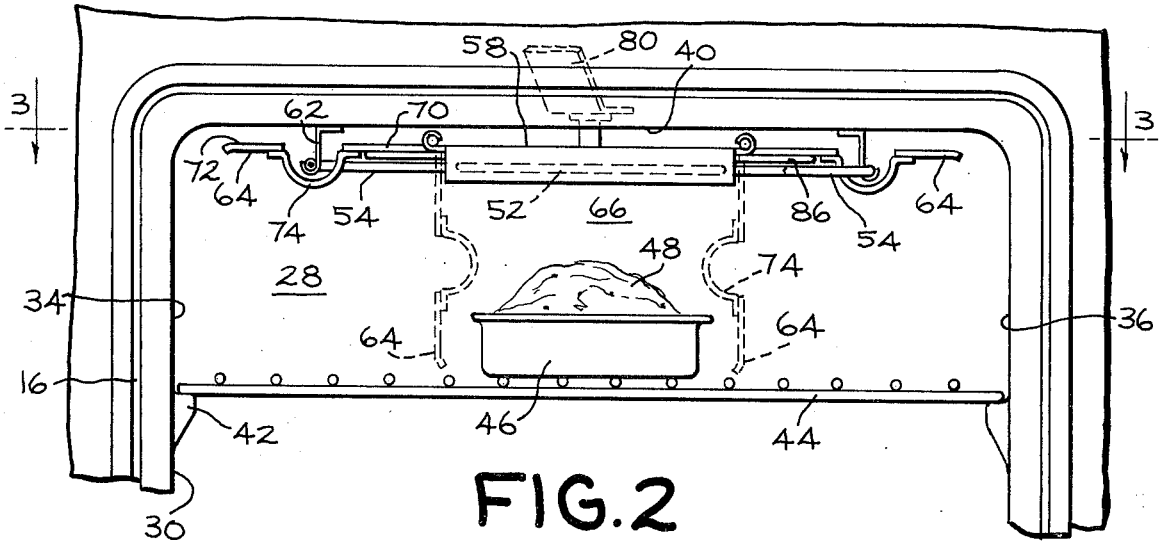
FIG. 2 is a fragmentary front elevational view on an enlarged scale of the top portion of the oven cooking cavity showing the oven rack supported in a high oven position, and inner and outer broil heating elements, and a pair of adjustable reflector plates shown in full lines in a raised generally horizontal position, and also shown in dotted lines in a lowered, generally vertical, parallel positions to form a miniature broiling compartment to substantially surround the food to be broiled on the oven shelf.

Turning now to a consideration of the drawings, and in particular to FIG. 1, there is shown for illustrative purposes a free-standing domestic range 10 having a top cooking surface 12 furnished with a plurality of surface heating units 14. A baking and broiling oven 16 is located beneath the cooktop 12. The oven has a front-opening access door 18, with a door handle 20 located near the top edge of the door. A backsplash 22 rises from the cooktop 12 along the back edge thereof, and it contains the conventional control components 24 for both the surface heating units 14 as well as the oven heating means. The control components 24 are illustrated diagrammatically since they do not form part of the present invention.

The front view of the oven 16 is shown with the oven door 18 open to expose the oven cooking cavity 28 that is formed by a box-like oven liner 30 and the oven door 18. The nature of the oven liner 30 may be best understood from the illustration in FIG. 3. The oven liner 30 has a bottom wall 32, opposite side walls 34 and 36, a rear wall 38, and a top wall 40 as is shown in FIG. 2. A series of vertically spaced rack supports 42 are arranged on each side wall 34 and 36 as is conventional in this art. A wire rack 44 is shown suspended between the side walls 34 and 36 by being supported on the top-most set of rack supports 42. This rack 44 is for supporting the food to be cooked, either directly on the rack or in a pan such as pan 46. The food is identified by reference numeral 48.

The oven cavity 28 would be furnished with a baking heating element (not shown) near the bottom wall 32 of the oven liner. It is not illustrated because the present invention relates to the broiling function of the oven. Just beneath the top wall 40 of the oven liner are a pair of broiling elements, an inner element 52 and an outer element 54. These heating elements are metal sheathed, electrical resistance heating elements of generally rectangular looped configuration that lie within substantially the same horizontal plane. Each heating element 52 and 54 has a pair of terminals such as 52' and 54' which extends out through the back wall 38 of the oven liner, for making an electrical connection therewith. Located above the inner broil element 52 is a fixed reflector 58 of stainless steel or aluminized steel that is supported from the top wall 40 of the oven liner. This fixed reflector 58 in turn includes on its underside a series of clips 60 for suspending the inner element 52 therefrom. A similar series of clips 62 serve to support the outer broil element 54 from the top wall 40 of the oven liner.

Joined to each of the opposing sides of the reflector 58 is an adjustable reflector plate 64 of stainless or aluminized steel or the like as by means of a hinge unit 65. These adjustable reflector plates have two operating positions, a first downward position as shown in dotted lines in FIG. 2 to form a pair of opposing walls that surround the food 48 to be broiled and form a miniature broiling compartment 66. Only the inner broil element 52 would be energized when the miniature broiling compartment 66 is to be used. Tests have proved that in this miniature broiling compartment it is possible to broil at 1400 watts the same food load that a 3000 watt or 3400 watt broil element or elements would broil using the entire oven cavity 28. Also the use of the miniature broiling compartment 66 requires less to perform the cooking because the radiant energy is substantially trapped by the reflective surfaces 58, 64 and 64 and it reflects between the broil element 52, the food 48 and back to the reflective surfaces in a continuing rebounding action.

Figure 3:
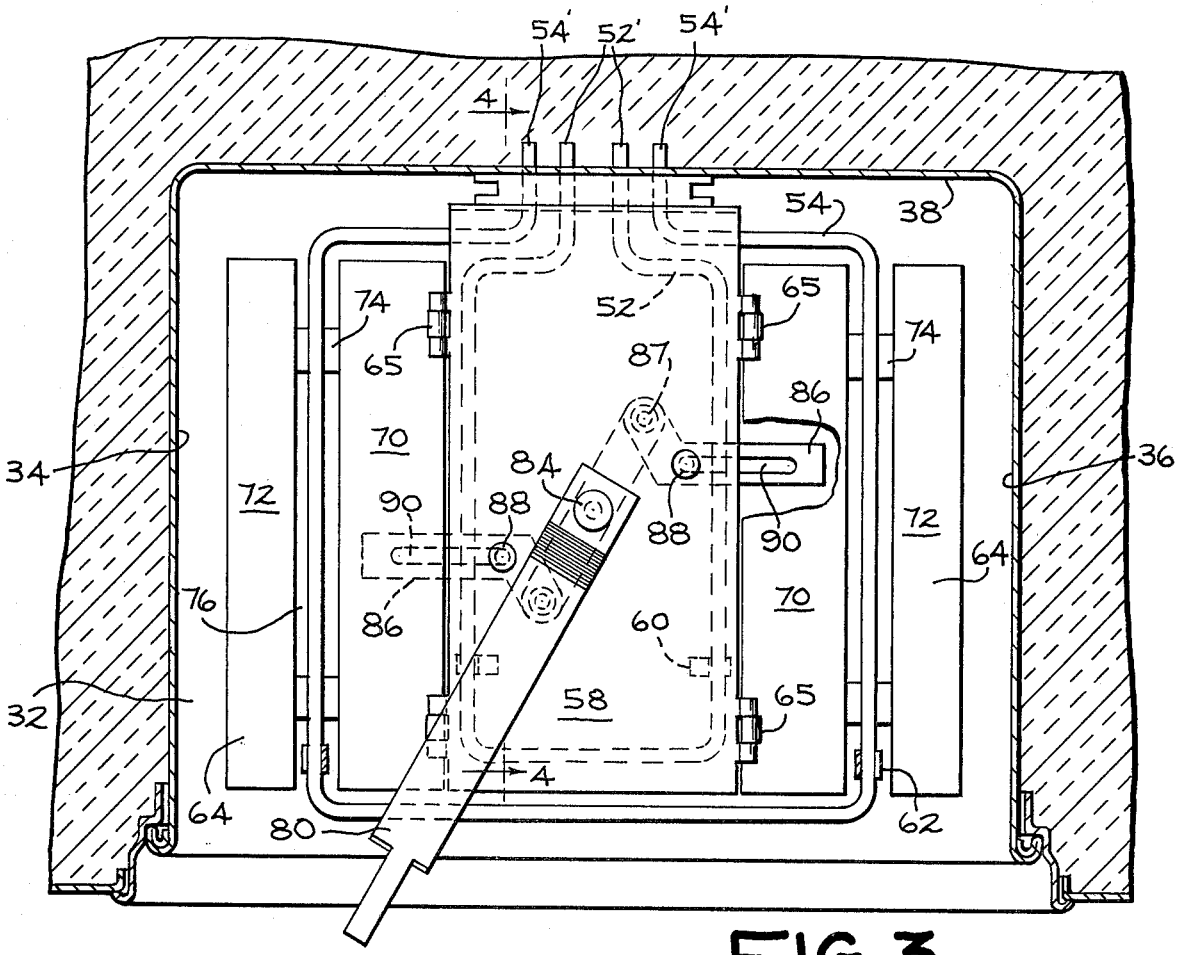
FIG. 3 is a cross-sectional top plan view taken generally on the line 3—3 just beneath the top wall of the oven liner, but also showing the handle for moving the adjustable reflector plates; the handle being located above the oven liner.
Figure 6:
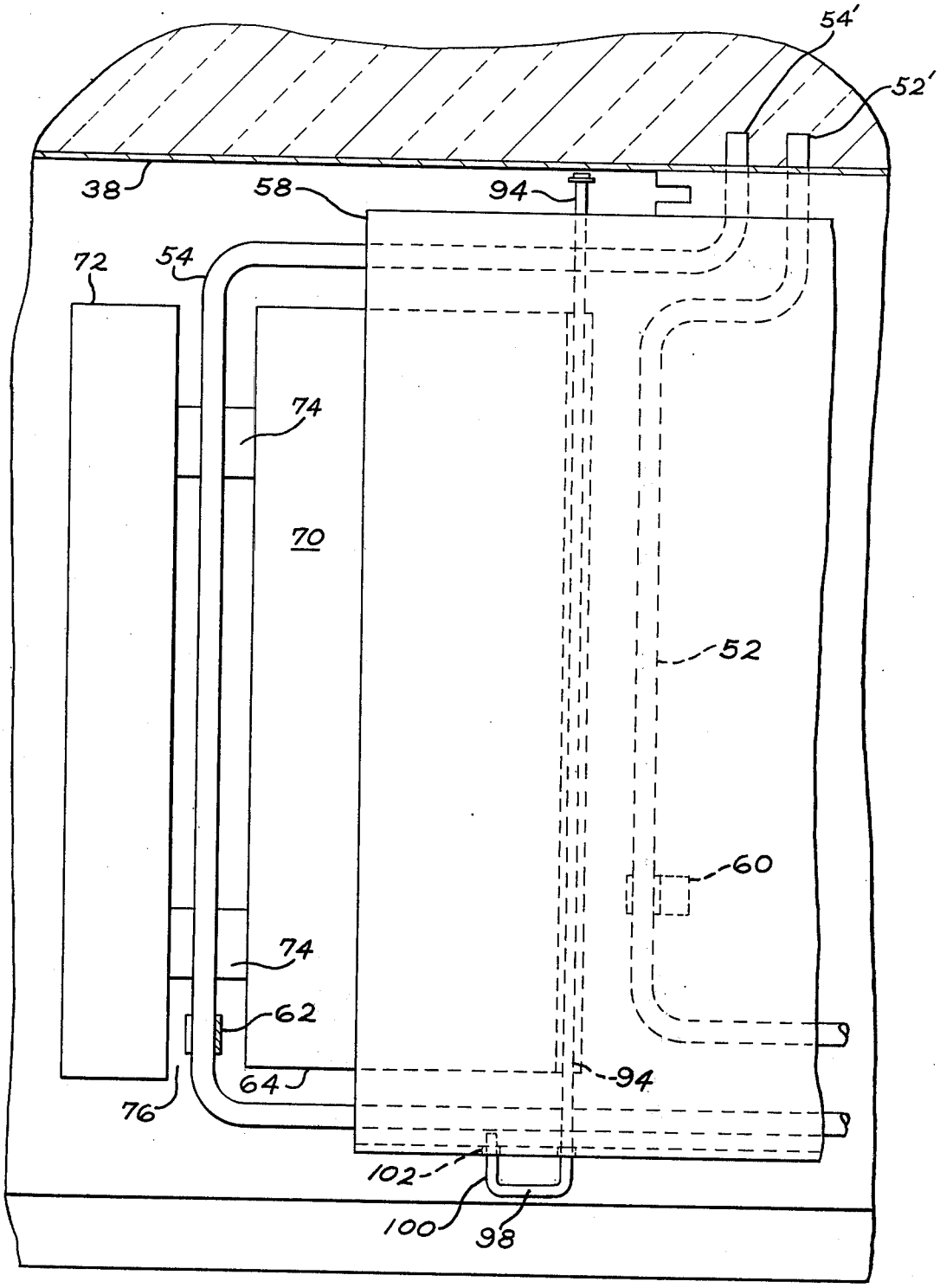
FIG. 6 is a fragmentary, cross-sectional top plan view of the modification of FIG. 5.

A second position of the adjustable reflector plates 64, 64 is in a raised, generally horizontal out of the way position as shown in full lines in FIG. 2. When in this raised solution it is important that the reflector plate 64 not cover or obscure the outer broil element 54. This objective is accomplished by forming each reflector plate 64 in two spaced pieces 70 and 72, as is seen in FIG. 3, which are joined by two narrow curved straps 74. This forms an elongated aperture 76 through which the outer broil element 54 may extend. Hence, the second raised position of the reflector plates 64 is above the outer broil element 54 so that both inner and outer broil elements 52 and 54 may be energized and radiate best energy down throughout the main oven cooking cavity 28.

A simple link mechanism is shown in FIG. 3 for supporting the adjustable reflector plates 64 in the raised position. Pivoted to the top wall 40 of the oven liner is a handle 80. The handle is located above the oven liner and it extends forwardly of the oven through an elongated slot 82 in the front frame of the oven, as is shown in FIG. 1. The handle is pivoted on a vertical shaft 84 to move between a left and right position. The left position is shown in FIG. 3 with the reflector plates 64, 64 in the raised position. The handle 80 includes a pair of pivoted link members 86 which are joined to the handle by pivot 87 and guided in their movement by a pivot pin 88 fastened to the fixed reflector 58 that engages in an elongated slot 90 of the link member. This link member 86 serves as an extendible finger to raise the reflector plate 64, or to lower the reflector plate by gravity when the link member is withdrawn from contact with the plate 64.

Another modification for supporting the reflector plate 64 is shown in FIG. 5. The reflector plate 64 is provided with a fixed elongated hinge pin 94 which is held by hinge means of the reflector plate 58 so the adjustable plate is capable of moving between a downward vertical position to an upward horizontal position. The hinge pin 94 is also capable of sliding longitudinally a slight amount. The front end of the hinge pin 94 has a turned up handle portion 98 that has a reentrant finger 100 that is capable of locking into a mating aperture 102. This locking action holds the reflector plate in its raised position. To lower the reflector plate, it is merely necessary to grasp the handle portion 98, pull it slightly to withdraw the finger 100 from the aperture 102 and then release hold so the reflector plate may swing down into its vertical position for forming the miniature broiling compartment 66.

Modification of this invention will occur to those skilled in this art, therefore, it is to be understood that this invention is not limited to the particular embodiments disclosed, but that it is intended to cover all modifications which are within the true spirit and scope of this invention as claimed.

What is claimed as new and is desired to be secured by Letters Patent of the United States is:

1. A broiling oven comprising an oven cooking cavity formed by a box-like oven liner and an access door, radiant heating means fixed substantially horizontally adjacent a top wall of the oven liner, an oven shelf for supporting food to be cooked thereon, and means for supporting the oven shelf in the top portion of the oven liner, below said heating means an adjustably mounted reflective means at each side of the heating means, each reflective means having a first downward position for forming with the other reflective means a miniature boiling compartment with relation to the said oven shelf and any food that may be placed thereon, so the food is adapted to be located between the two reflective means, and below said heating means the reflective means having a second raised position which enables the radiant heating means to radiate througout much of the oven cooking cavity.

2. A broiling oven as recited in claim 1 wherein the said radiant heating means includes an inner and an outer heating element of looped configuration, the said adjustably mounted reflective means being hingedly supported between the inner and the outer heating elements, and control means for the two heating elements so that only the inner heating element is energized when the reflective means are positioned in their first downward position to form the miniature broiling compartment so as to conserve heating energy by improving the efficiency of broiling small portions of food and using lower powered heaters.

3. A broiling oven as recited in claim 2 wherein the reflective means "overlap the outer heating element in their raised position and each of the reflective means" is provided with aperture means aligned with a portion of the outer heating element when the reflective means is in its second raised position so as to permit the radiant energy of the outer heating element to transmit downwardly through the aperture means and throughout the oven cooking cavity, said control means serving to energize both the inner and the outer heating element when broiling in the overall oven cooking cavity.

4. A broiling oven as recited in claim 3 with the addition of manually adjustable support means for holding the reflective means in the second raised position, and means for releasing the said support means to permit the reflective means to move to the first downward position.

5. A broiling oven as recited in claim 1 with a fixed reflector means mounted between the said radiant heating means and the top wall of the oven liner, the said adjustably mounted reflective means being hinged to opposing sides of said reflector means, whereby the said miniature broiling compartment is formed by the combination of the said reflector means and the two adjustably mounted reflective means when they are positioned in their first downward position with the food being located therebetween.

6. A broiling oven as recited in claim 5 wherein the said radiant heating means includes an inner and an outer heating element of looped configuration, the said reflector means being mounted above the inner heating element and said reflective means being bingedly supported between the inner and outer heating elements, and control means for the two heating elements so that only the inner heating element is energized when the reflective means are positioned in their first downward position so as to improve the efficiency of broiling small amounts of food

7. A broiling oven as recited in claim 6, wherein the said reflective means overlap the outer heating element in their raised position and are provided with aperture means aligned with a portion of the outer heating element when the reflective means are in their second raised position so the energy of the outer heating element may radiate downwardly over a wide area.

8. A broiling oven as recited in claim 5 wherein each of said reflective means is formed integrally with an elongated hinging means that joins the reflective means to the said reflector means, said hinging means having a handle portion which may be locked with relation to the reflector means when the reflective means is in its second raised position for supporting the reflective means, and means for releasing the handle from its locked position for lowering the reflective means into the first downwardly position.

9. A broiling over as recited in claim 5 with the addition of manually adjustable support means cooperating with the said reflector means, said support means being extendible to engage the reflective means and pivot them up to the second raised position, said support means also being retractible for releasing the reflective means and allowing them to assure their first downward position.

10. A broiling oven as recited in claim 9 wherein the said manually adjustable support means includes an operating handle means which extends outwardly of the oven liner so that the reflective means may be adjusted from outside the oven.

* * * * *